US006263999B1

(12) United States Patent
Atkinson et al.

(10) Patent No.: US 6,263,999 B1
(45) **Date of Patent: *Jul. 24, 2001**

(54) REMOVABLE VERTICAL FALL ARREST DEVICE

(75) Inventors: Geoffrey Fraser Atkinson, Chippenham; David John Patterson, Calne, both of (GB)

(73) Assignee: Latchways Limited, Calne (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/732,235

(22) PCT Filed: Mar. 31, 1995

(86) PCT No.: PCT/GB97/00734

§ 371 Date: Jan. 7, 1997

§ 102(e) Date: Jan. 7, 1997

(87) PCT Pub. No.: WO95/26784

PCT Pub. Date: Oct. 12, 1995

(Under 37 CFR 1.47)

(30) Foreign Application Priority Data

Mar. 31, 1994 (GB) ..... 9406486

(51) Int. Cl.[7] ..... A62B 35/04

(52) U.S. Cl. ..... 182/5; 188/65.1; 254/405

(58) Field of Search ..... 182/4, 5, 8, 71, 182/72, 191; 188/65.1, 65.2; 254/391, 405, 407

(56) References Cited

U.S. PATENT DOCUMENTS

| | | | | |
|---|---|---|---|---|
| 4,521,000 | * | 6/1985 | Dodge, Jr. | 182/5 X |
| 4,846,075 | * | 7/1989 | Tupper | 188/65.1 X |
| 4,923,037 | | 5/1990 | Stephenson . | |
| 5,156,240 | * | 10/1992 | Ostrobrod | 182/5 X |
| 5,316,103 | * | 5/1994 | Bell et al. | 182/5 X |

FOREIGN PATENT DOCUMENTS

| | | |
|---|---|---|
| 163563 | 12/1985 | (EP) . |
| 272782 | 6/1988 | (EP) . |

* cited by examiner

*Primary Examiner*—Daniel P. Stodola
(74) *Attorney, Agent, or Firm*—Klauber & Jackson

(57) ABSTRACT

A vertical fall arrest device that combines, in a single unit, a fall arrest function, the capability to automatically traverse intermediate supports provided along a safety line and ease of attachment and detachment from the safety line at any point throughout the length of the safety line with dismantling the device. When the device is attached to the safety line, the safety line is captured in a retaining recess and is always in a ready state to lock-on to the safety line in the event of a fall condition. The device can be removed from the safety line easily and without disassembly by depressing a release catch while at the same time pulling a rotatable member a limited distance in a direction away from the main body. The rotatable member moves away from the main body against a spring bias and creates an opening for the withdrawal of the safety line from its captured position. When the pulling force is relaxed, the spring bias causes the rotatable member to relax to the fully locked position. Thus, the device can be readily attached to and detached from the safety line without being dismantled.

14 Claims, 13 Drawing Sheets

FIG. 12
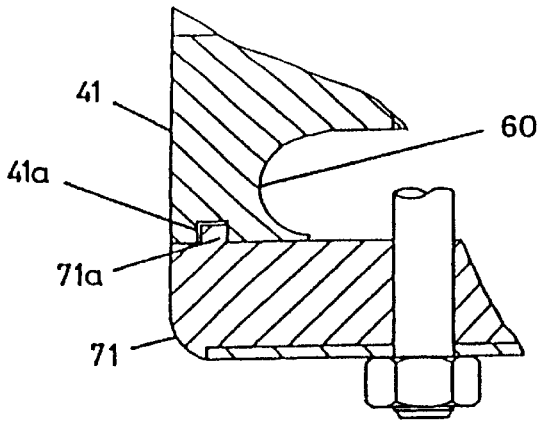
FIG. 13
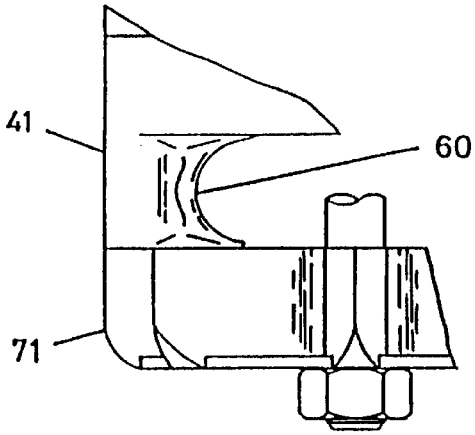
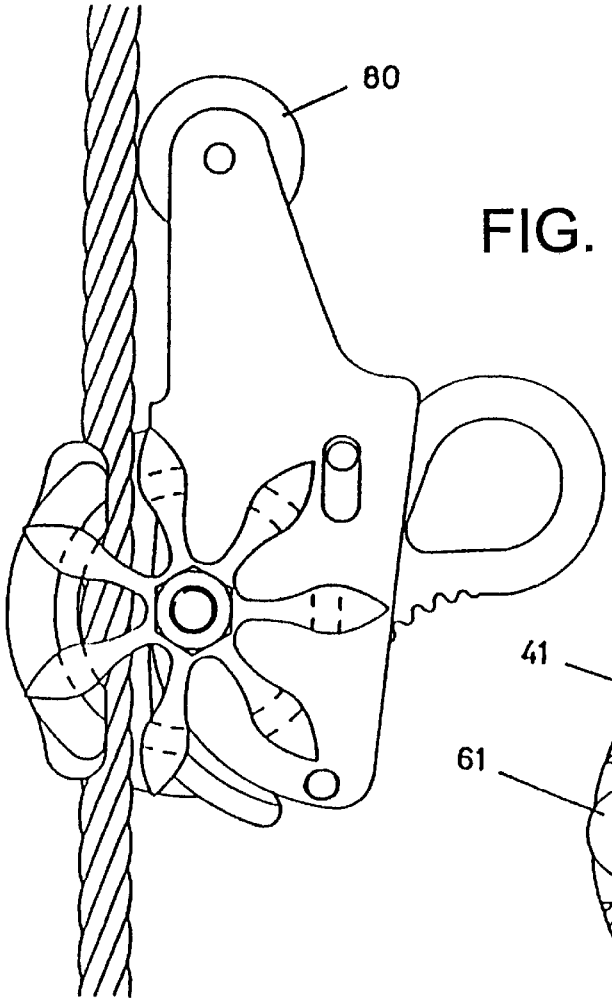
FIG. 14
FIG. 15
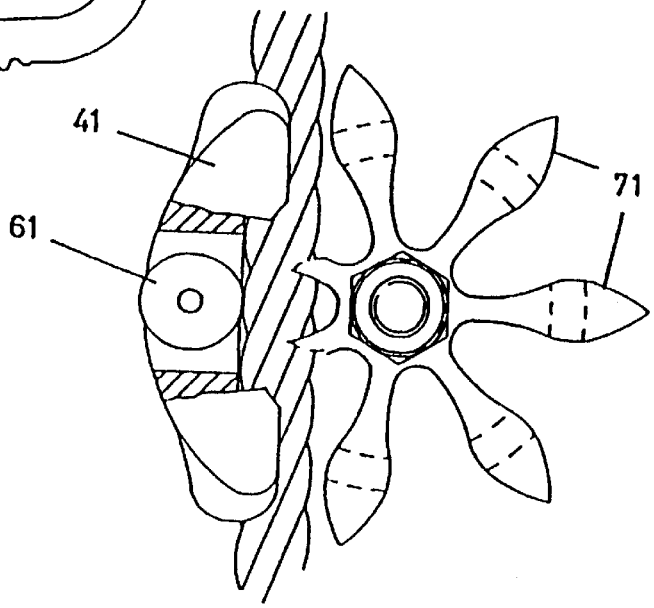

REMOVABLE VERTICAL FALL ARREST DEVICE

The present invention relates to vertical fall arrest devices, and in particular to vertical fall arrest devices adapted for easy attachment to and detachment from a safety cable or the like.

Vertical fall arrest devices are an important accessory for maintenance personnel who climb tall structures since they enable the hazard of falls to be minimised. Vertical fall arrest systems which employ a safety line such as a flexible cable for engagement by the fall arrest device require intermediate support brackets to restrain the cable from buffeting against the tall structure while under wind loading. Such systems therefore present a practical problem of enabling the fall arrest device (and the user) to bypass the support brackets without increasing the fall hazard.

Certain known designs attempt to overcome this bypass problem by using a manually operated bracket lock. This requires the user to open and close the bracket when he traverses it. Other known designs require that the user should lean out from the normal climb/descend posture and pull the cable away from the bracket in order to move the fall arrest device past the bracket position. Both of these methods significantly add to the difficulty of the climb, are more tiring and hence possibly increase the fall hazard.

Another problem facing maintenance personnel on very tall structures such as telecommunication pylons, masts etc. is the provision of a number of discrete vertical fall arrest systems up the side of the structure. This is due to the fact that ladder placement is often along a number of different climbing axes. Such structures may therefore require the detachment and re-attachment of the fall arrest device at any point during the climb or descent, and the ease by which this can be achieved is an important factor in determining the overall safety of the manoeuvre.

It is therefore an object of the present invention to provide a vertical fall arrest device which is capable of negotiating all intermediate safety line support brackets without user input and which also allows access to and egress from the safety line at any point without the need for special entry/exit fittings on the vertical fall arrest system.

The invention is a vertical fall arrest device for use on an elongate safety line, said device comprising:

a body member;

a rotary member having at least one recess formed in its periphery;

safety line retaining means extending between the body member and the rotary member and being adapted to retain a safety line in a space defined between the body member and the rotary member;

biasing means to urge said locking means into locking engagement with a safety line accommodated in the safety line retaining means in response to a sudden change in load experienced by the device, and means for attaching a personnel safety cable to the device;

wherein said rotary member is rotatably mounted in relation to the retaining means and wherein the or each recess formed in the periphery of the rotary member is adapted to traverse support means used to support an elongate safety line without the need for user manipulation by rotation of the rotary member relative to the retaining means such that elements of said support means are successively received, guided and passed by a recess automatically;

characterised in that at least one of the rotary member, the body member and the retaining means is movable relative to the others of such parts to enable a safety line to be introduced into or removed from said space so as to allow the device to be attached to or detached from the safety line.

A device constructed in accordance with the invention is especially advantageous because it provides, for the first time in a single unit, the means to arrest a fall, the capability to automatically traverse intermediate support means provided along a safety line, and ease of attachment to or detachment from the safety line at any point throughout its length.

Conveniently, the relative movement between at least one of the rotary member, the body and the retaining means is movement in a direction away from the other parts. Alternatively, the parts may be slidable relative to one another, or they may be rotatable. The important feature is the ability to create a gap between them which allows a safety line to be introduced or removed from the space defined between the body member and the rotary member.

Advantageously, the device incorporates releasable means for maintaining the rotary member, the body and the retaining means in a closed condition in which introduction or removal of a safety line is prevented. This feature means that a conscious decision must be taken on the part of the user to open the device. Preferably, the releasable means includes a positive latching mechanism which retains the parts in the closed condition against accidental release. The latching mechanism may be biased to its non-release position for added safety.

In an especially preferred form, the device is converted to the attachment/detachment condition by operating a release mechanism against biasing pressure and at the same time pulling the rotary member against biasing pressure in a direction away from the body. This action creates an opening for insertion or removal of a safety line.

With no external forces applied, the internal biasing mechanisms ensure that the rotary member returns to its fully locked position and the release means returns, together with the latching mechanism, to the fully latched condition. Various designs of release means may be adopted, including push button, safety pin, pull-release or rotary mechanisms.

In a preferred form of the invention, a spindle upon which the rotary member is rotatably mounted is locked into the body. The spindle may not be pulled away from the body without first operating a release catch, and hence disengaging the locking mechanism, by an intentional action. In the closed and locked condition, it is not possible for the device to be removed from or attached to a safety line. When attached to a safety line, the device is always in a ready state to grip the safety line firmly in the event of a fall.

By virtue of the fact that the removable vertical fall arrest device of the present invention has a single rotary member in juxtaposition with the body member, it will be apparent to persons skilled in the art that the device is "handed". In a working personnel safety system attached to a tall structure, it is also necessary for the intermediate brackets supporting the safety line to be consistently "handed" for correct traversing.

However, with a removable device, there is a remote possibility that the device could be inverted and incorrectly installed on the safety line. To avoid this, the invention may incorporate a safety mechanism which prevents the release means from being actuated. Only when the device is correctly oriented can the release means be moved to an unlatched position allowing the opening of the device and its attachment to a safety line.

In an especially preferred form of the invention, the release means for the latching mechanism incorporates a safety mechanism which alerts the user to the fact that the device is being attached in the wrong orientation.

The safety mechanism may be in the form of a detent member which is freely-movable under the influence of gravity between first and second positions, according to the orientation of the device. The direction of free movement is arranged to be substantially parallel to the suspension axis of the device.

In one of said first and second positions, the detent member engages with the release means and jams it against actuation, thereby discouraging attachment of the device in the wrong orientation. Then, if the device is inverted, the detent member moves to the other position which frees the release means and renders it operable. Only by crossing or changing hands can the user attach the device incorrectly.

The detent member may be a ball which rolls or a pin which slides in a channel provided in the body member or a cover member associated therewith. Alternatively, the detent member may be housed in the release means and may move into a notch or cut-out portion in the body member or its associated cover member. If required, the feature which does not house the detent member may be provided with a detent-engaging formation such as a notch or a raised portion to ensure that there is effective interaction with the detent in the non-release condition. Another alternative form of detent member is a pawl mounted on a pivot.

Other variants of the invention include the provision of a groove on the surface of the rotary member facing the body of the device, for cooperation with a raised projection formed on the body. This helps to maintain the relatively rotatable parts in their respective operating relationships.

Alternatively, a groove may be provided in the body and/or retaining means which receives a cooperating projection formed on the rotary member.

In one form of the invention, the groove may be so formed that it surrounds the head portion of the projection or projections and thereby effects a positive engagement between the cooperating parts. Such an arrangement would allow the rotary member, for example, to be positively engaged with the retaining means so that the two are movable as a unitary element in relation to the body member. An example of this type of arrangement is one in which the head portion of the projection or projections has a dove-tail cross-section and in which the groove has a corresponding undercut profile.

In yet another embodiment, neither the body, the retaining means nor the rotary member have any grooves and/or projections.

The rotary member may be in the form of a wheel having a plurality of petals projecting radially from the hub of the wheel. The petals then define, between adjacent pairs thereof, recesses of the type required for automatic traversing of safety line support brackets. The provision of a number of recesses may be helpful in aligning the device with respective elements of successive safety line supports during a lengthy climb or descent.

Preferably, the device is provided with at least one slipper pad which helps to maintain the desired orientation of the invention with respect to the safety line during climb or descent. Such a slipper pad runs against the safety line in advance of (or behind) the body. The slipper pad or pads may be substituted by or equipped with a roller or rollers to assist in normal passage of the device along the safety line.

In another form of the invention, one or more rollers may be included in the retaining means to ease passage of the device along the safety line in normal use. The position of the roller is chosen such that the lock-on capability of the device is not compromised.

The features of the present invention may be used in combination with the vertical fall arrest device described in the Applicant's co-pending British Patent Application No. 9419129.3, the entire disclosure of which is incorporated herein by reference.

The present invention will now be described by way of example only with reference to the drawings, in which:

FIGS. 1(*a*) and 1(*b*) show various views of a typical industrial ladder supporting a vertical safety line;

FIGS. 2(*a*) and 2(*b*) show side and end elevations of a typical safety line support bracket;

FIGS. 3(*a*) and 3(*b*) show two part-sectional views through a device according to the invention, looking in a direction along the axis of a safety line;

Figure 7B:
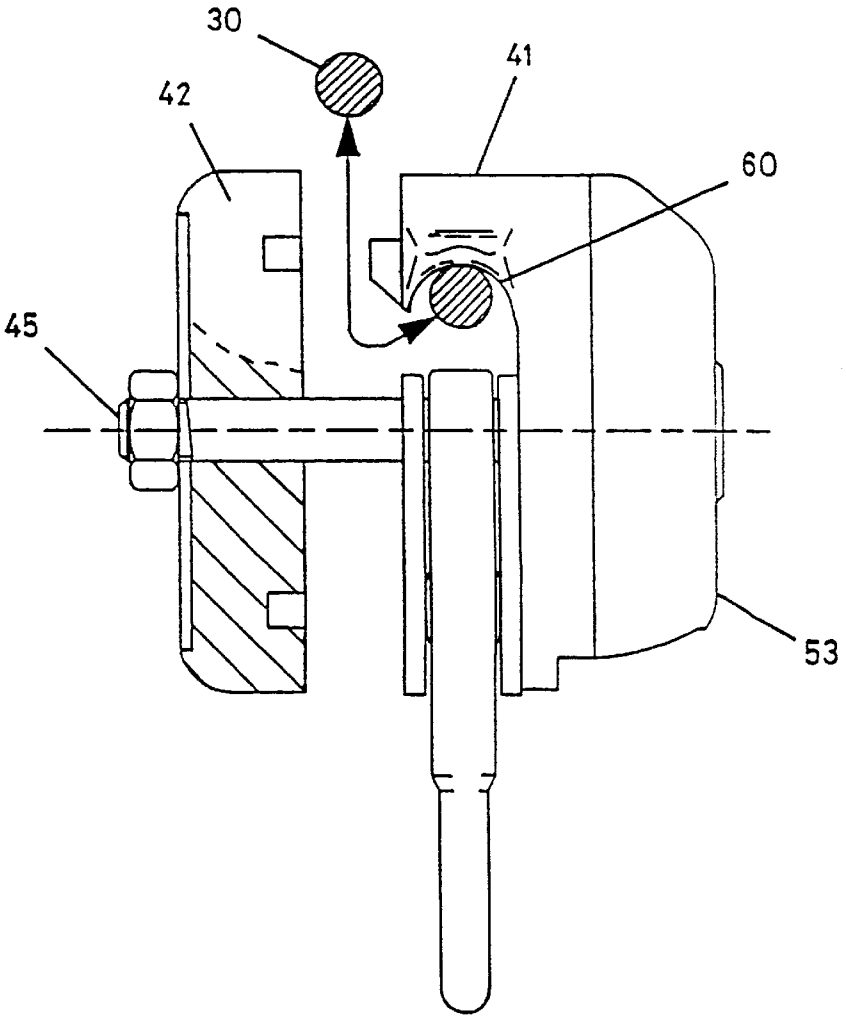
Figure 7A:
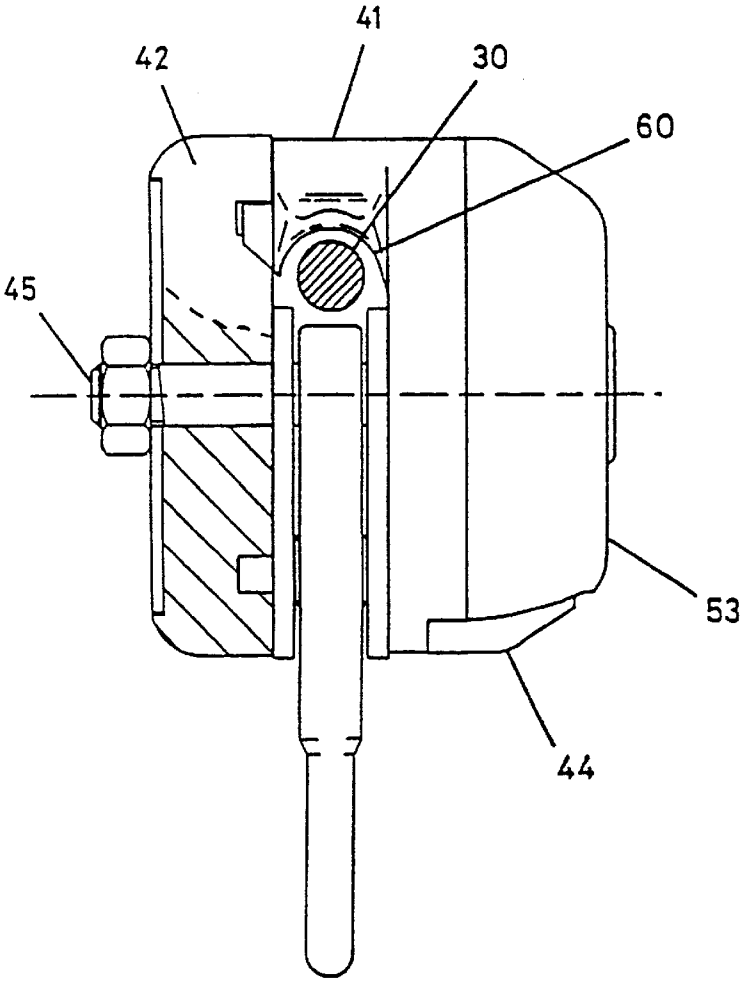
Figure 8B:
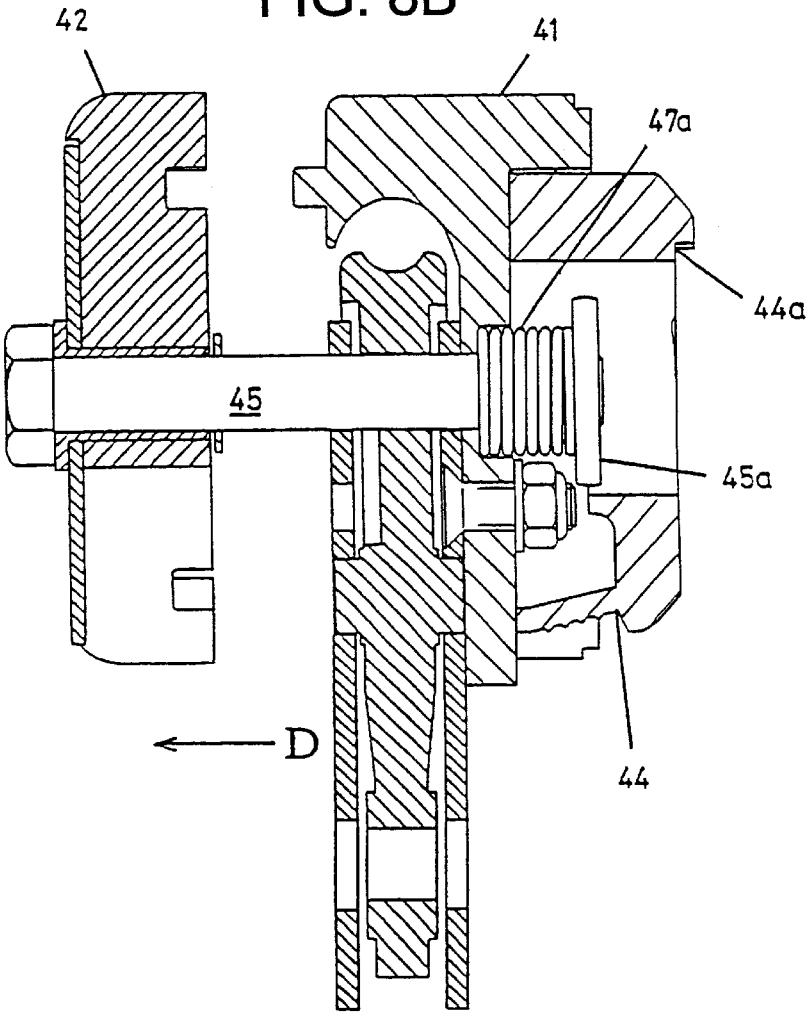
Figure 8A:
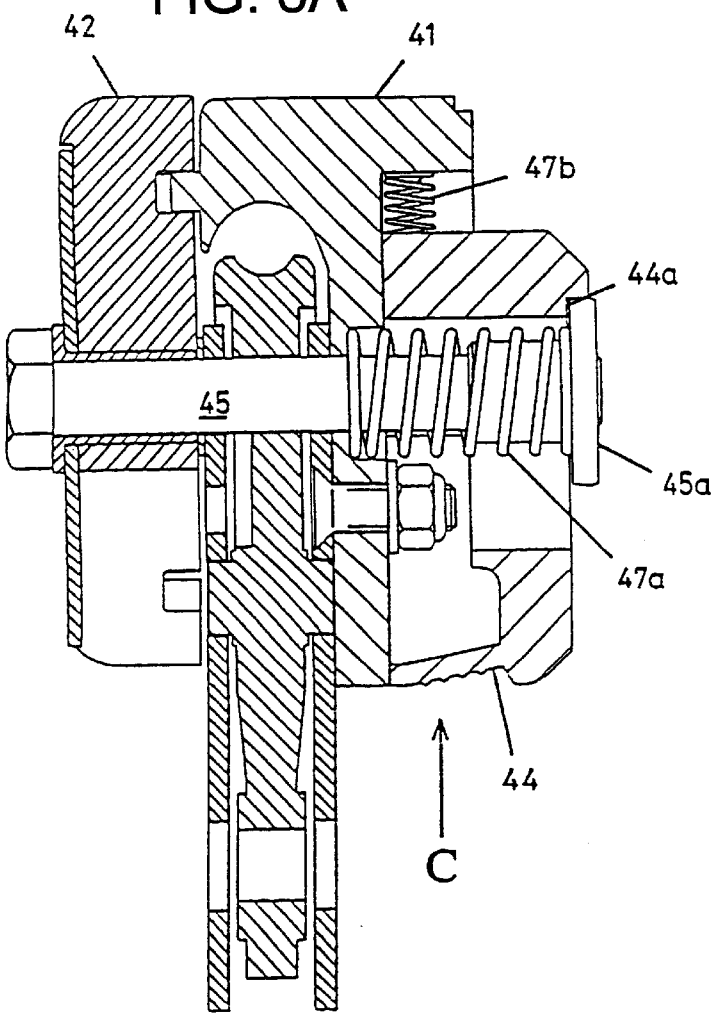
Figure 9C:
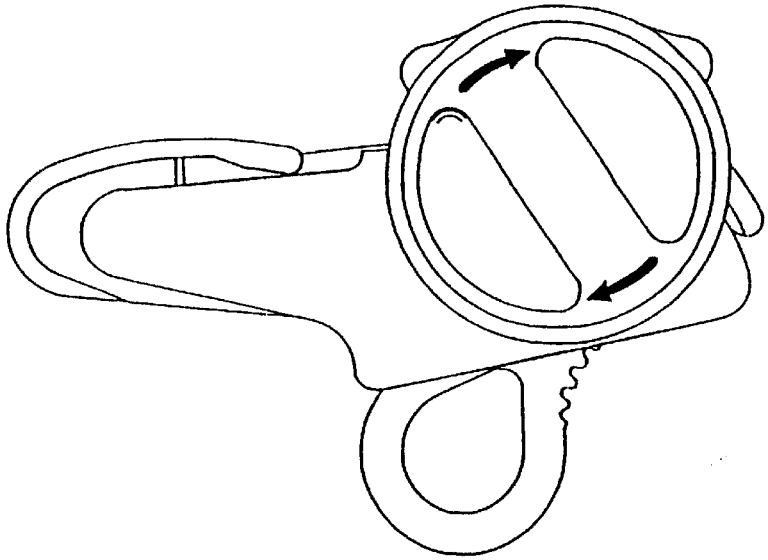
Figure 9B:
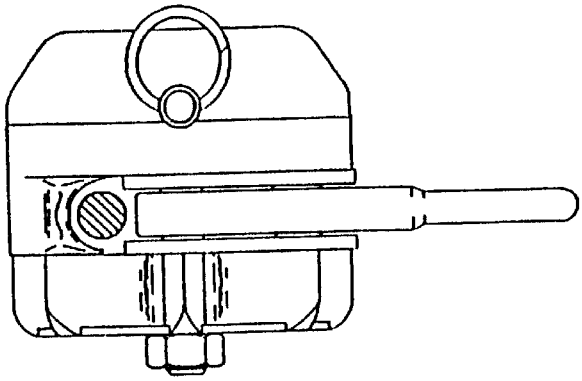
Figure 9A:
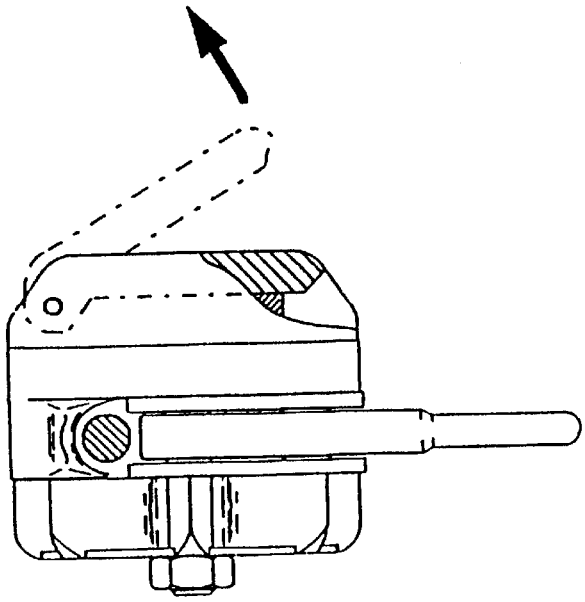
Figures 10A, 10B, 10C:
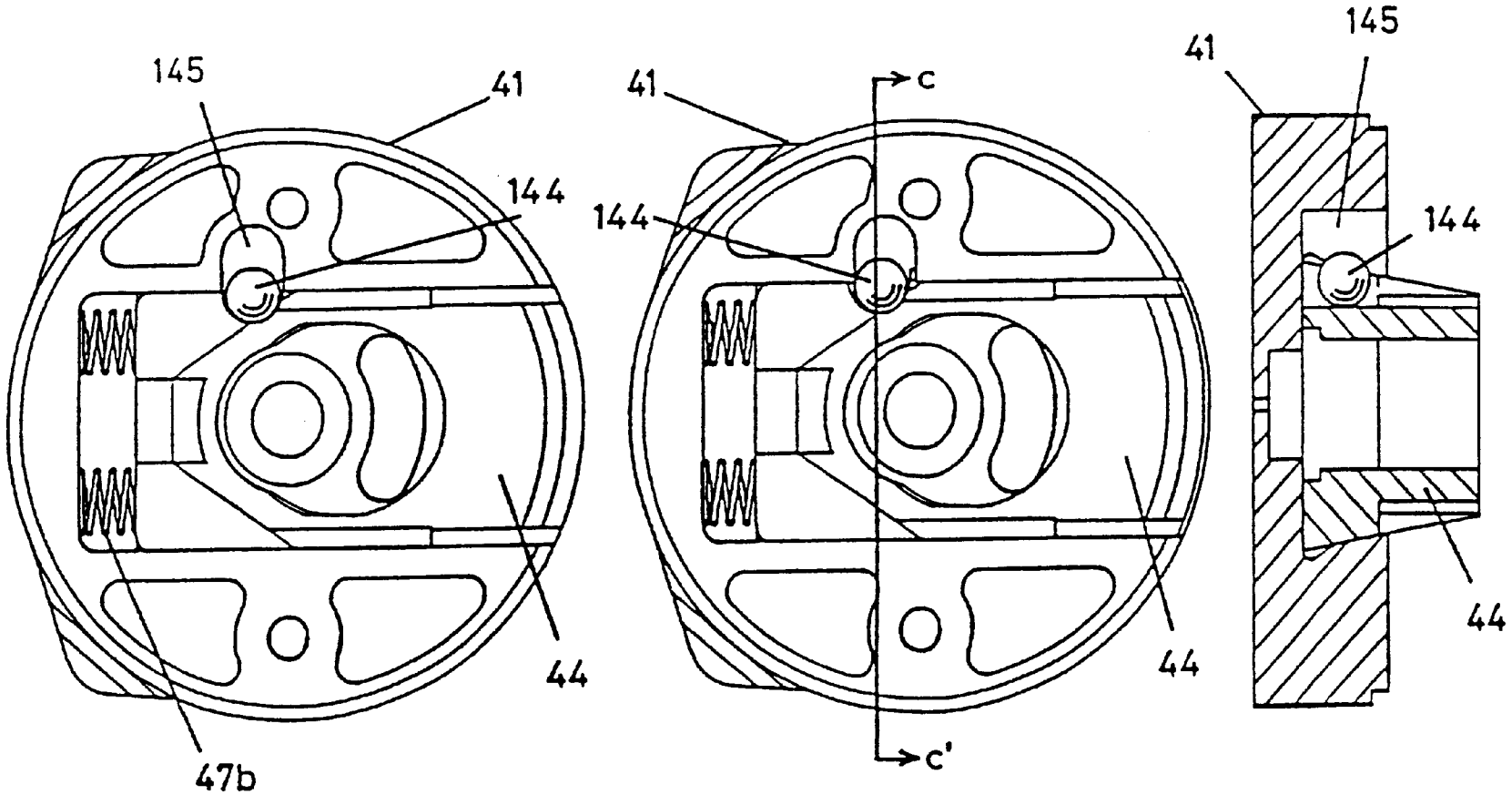
Figure 10F:
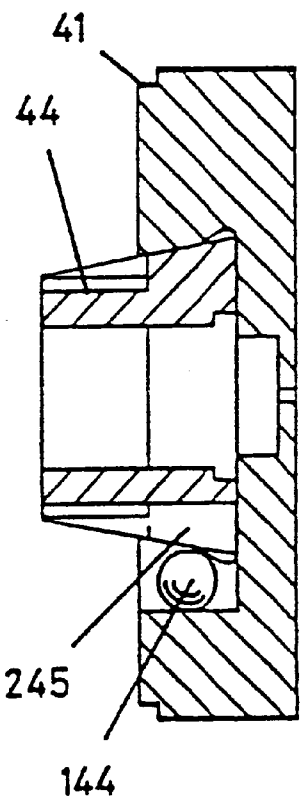
Figure 10E:
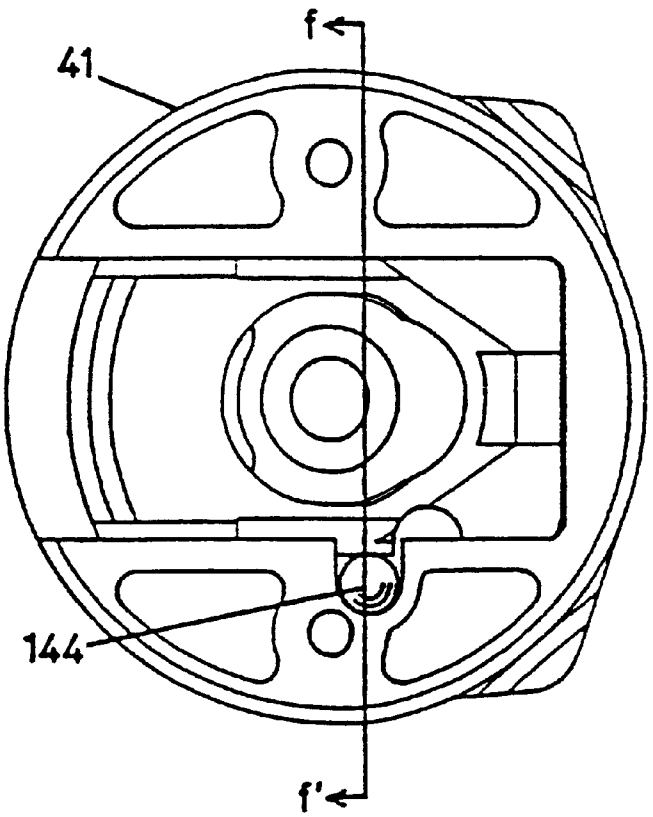
Figure 10D:
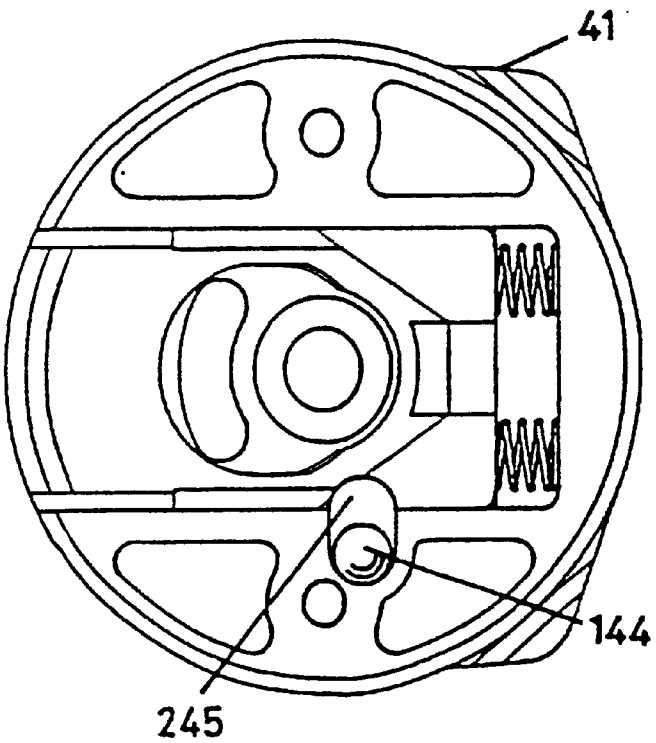
Figure 11A:
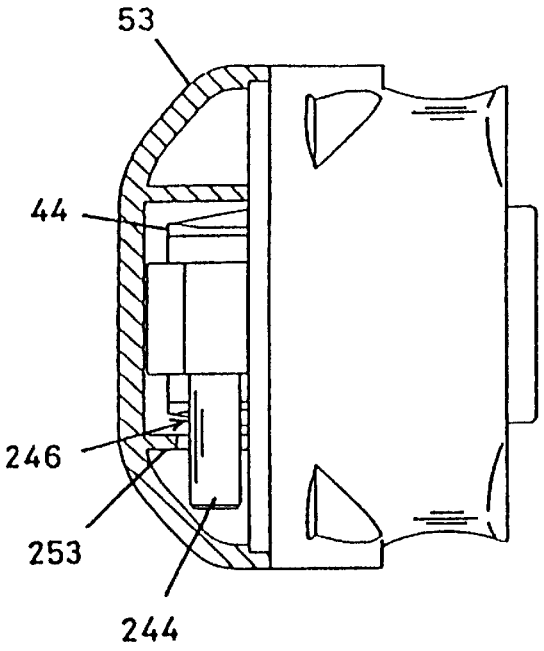
Figure 11B:
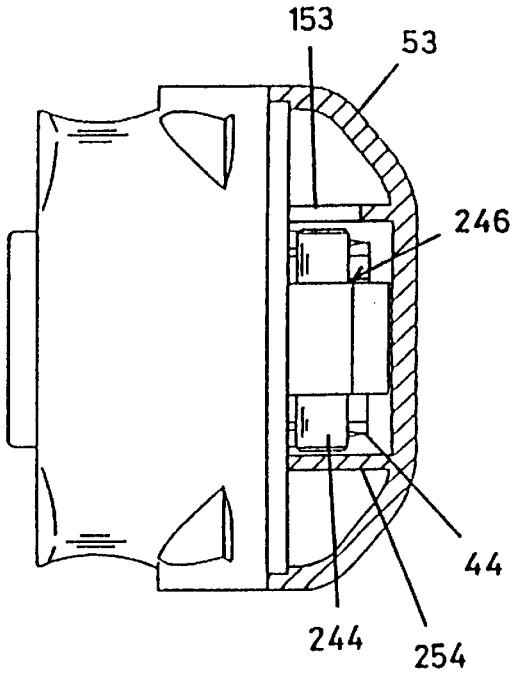
Figure 11C:
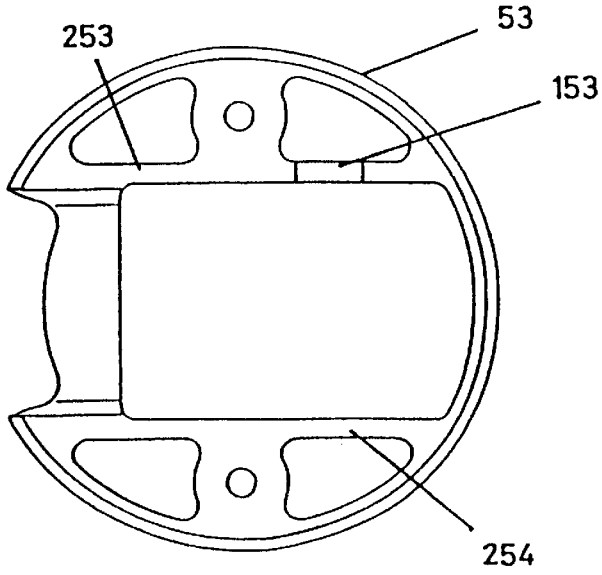

FIGS. 6(*a*)–6(*b*) show, in stages, the passage of a device in accordance with the invention past a typical safety line support bracket;

FIGS. 7(*a*) and 7(*b*) show views of a device according to the invention in the closed condition and in the attachment/detachment condition;

FIGS. 8(*a*) and 8(*b*) show cross-sectional views of a device similar to that of FIG. 7 in a direction looking along the axis of a safety line and with the cover omitted for clarity;

FIGS. 9(*a*)–9(*c*) show shows a variety of mechanisms for putting the release means of the invention into effect;

FIGS. 10(*a*)–10(*f*) show a variant of the invention incorporating a safety mechanism to inhibit incorrect attachment;

FIGS. 11(*a*)–11(*c*) show an alternative form of safety mechanism from the FIG. 10 embodiment, and FIGS. 12, 13, 14 and 15 show some design variants of the invention.

Figure 1A:
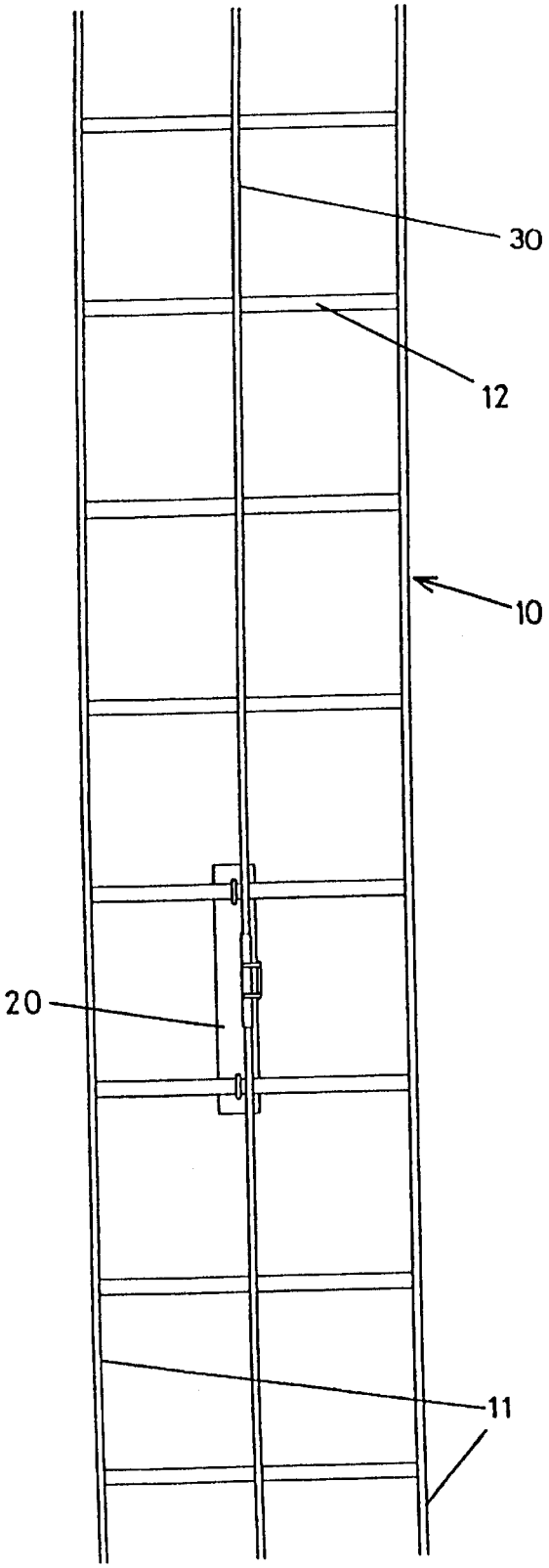
Figure 1B:
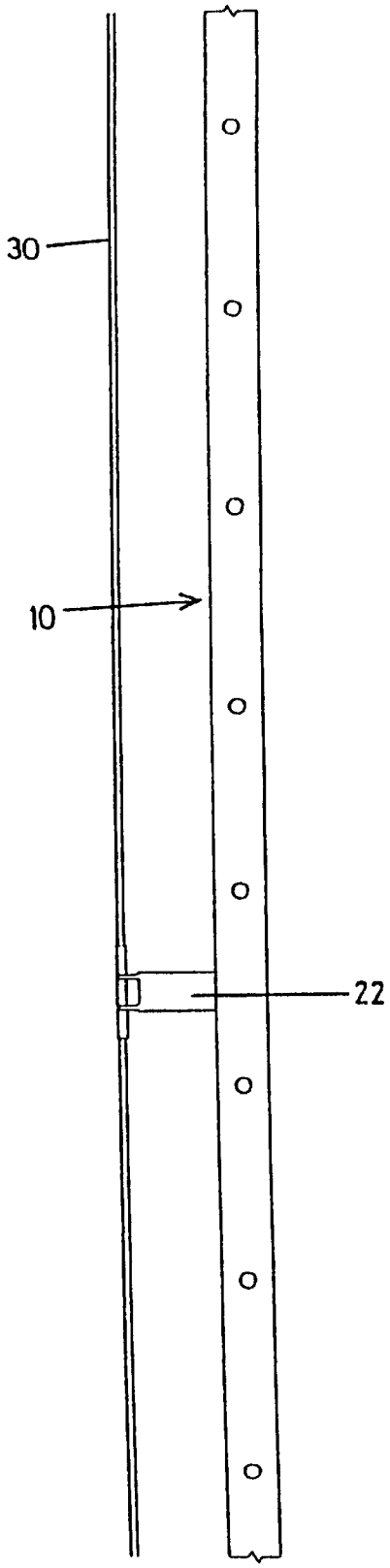

Referring now to FIG. 1, view (a) shows a typical industrial ladder 10 with a safety line 30 supported centrally an equal distance from its respective stiles 11. Safety line 30 is held in position in relation to the ladder 10 by a number of supporting brackets 20 which are in turn supported by the rungs 12 of the ladder 10. Only one such bracket 20 is shown. View (b) is a side elevation showing how the suspension axis of the safety line is separated from the plane of the ladder 10 by a pre-determined distance.

Figure 2A:
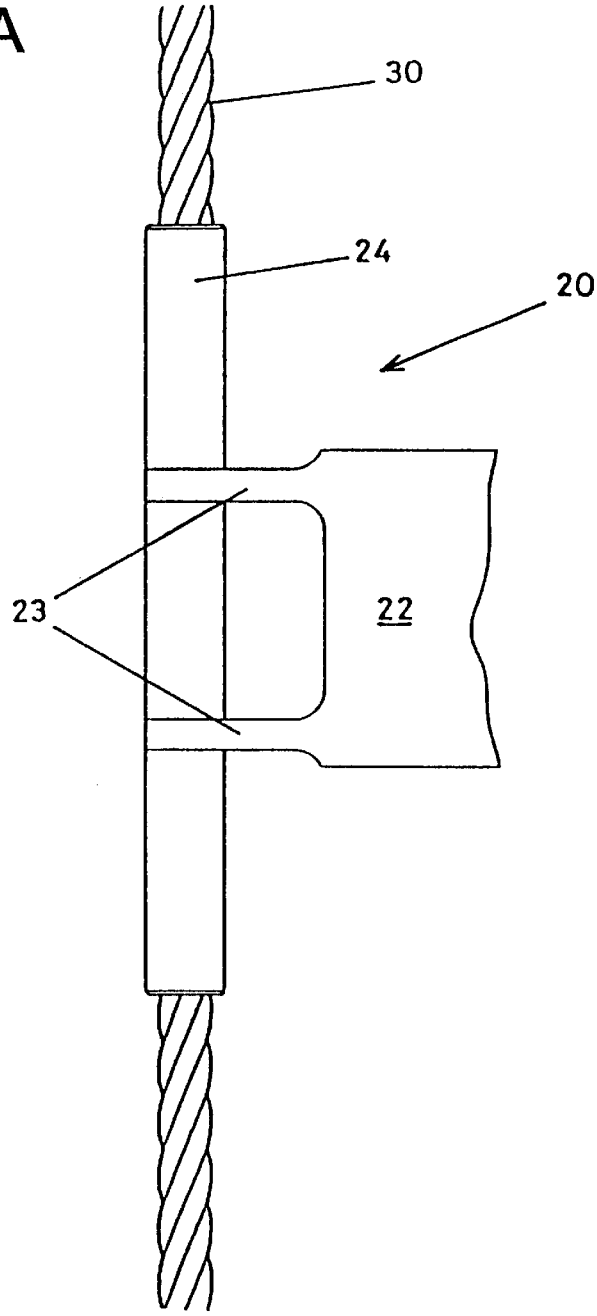
Figure 2B:
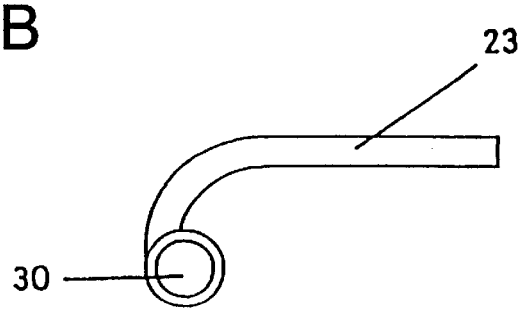

In FIG. 2, view (a) is a close-up view showing how the safety line 30 passes through a guide tube 24 attached to the bracket body 22 by bracket legs 23. View (b) is a view along the axis of the safety line 30 showing how a bracket leg 23 is attached to the guide tube 24. In this view, it can be seen that the safety line support has an inherent "handedness", the importance of which will become apparent in the explanation below.

Figure 3A:
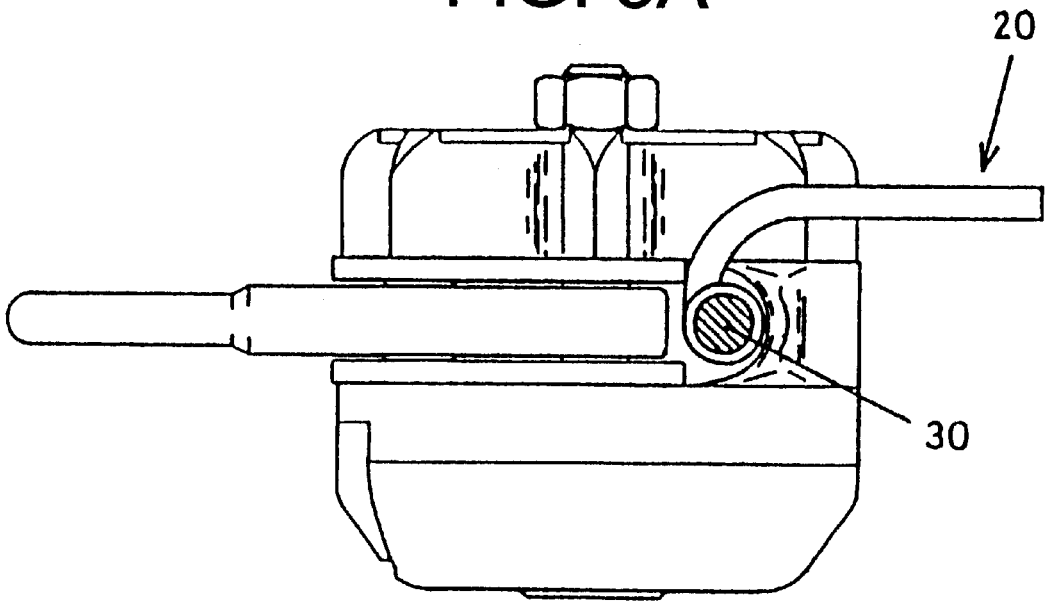
Figure 3B:
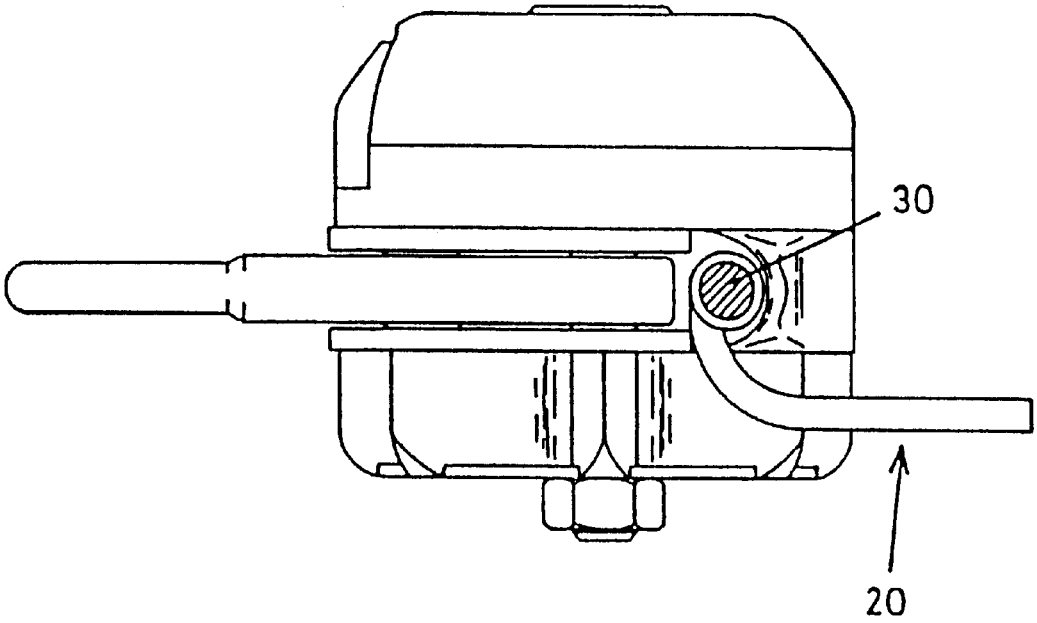

FIG. 3 shows a pair of part-sectional views through the invention looking in a direction along the axis of a safety line 30. As indicated above, support brackets 20 for the safety line 30 may be installed in either "left-handed" or "right-handed" versions. To accommodate this, the invention is also suitably handed. It is to be noted that, for satisfactory operation of the invention, all support brackets must be handed in the same sense to match the handing of the attachment device. A mixture of left and right handing cannot be accommodated by the invention. Thus, for a safety line system which exclusively employs left-handed brackets, the device shown in FIG. 3(*a*) would be employed. Conversely, for a safety line system with only right-handed brackets, the device of FIG. 3(*b*) would be used.

Figure 4:
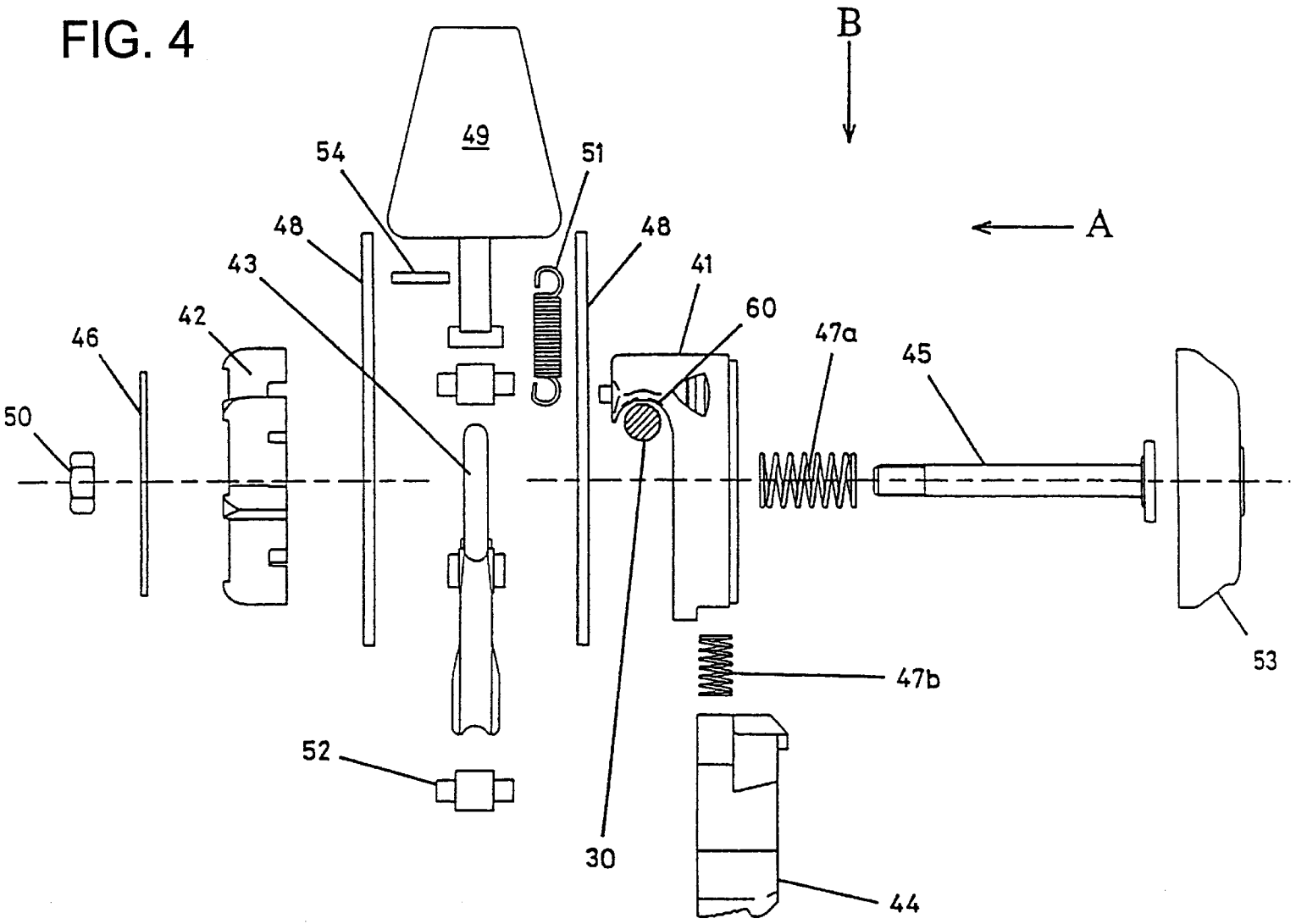
FIG. 4 shows an exploded view of a left-handed version of a device according to the invention.

Turning now to FIG. 4, there is shown an exploded view of a left-handed version of the invention, such as depicted in FIG. 3(*a*). The device includes a cam member 43 which is pivotable on bosses located in a pair of side plates 48 disposed one on either side of the cam member. Biasing means in the form of a tension spring 51 is attached to the cam member 43 at one end and to a fixed member such as a dowel 54 at the other end. The effect of the biasing means is to bias the pivotal movement of the cam member 43 in a direction towards the lock-on condition in which a safety line 30 is tightly gripped by the device.

A slipper pad 49 is also secured between the side plates 48. The separation between the side plates 48 is determined by a plurality of spacers 52. The cam member 43, dowel 54, slipper pad 49 and spacers 52 are all entrapped between the slide pates 48.

A bolt 45 passes through corresponding holes formed in the side plates 48 and protrudes beyond said side plates 48 at either end. The bolt 45 serves as a spindle for a wheel 42 assembled on the outside of the one of the side plates 48. The wheel 42 is retained on the spindle by a locknut 50 which engages with a threaded portion at one end of the bolt 45. An intermediate disc 46 is also placed on the bolt between the wheel 42 and locknut 50 to ensure freedom of rotation of the wheel 42. At the other end, and on the outside of the other side plate 48, the bolt 45 passes through a body member 41 which is integrally formed with retaining means in the form of a safety line retaining recess 60. Further biasing means in the form of springs 47 are provided on this side of the device. The first of these serves to urge a lock release catch 44 into its non-release position in normal use of the device. The user therefore has to undertake an intentional action to operate the lock release catch 44. The second spring 47 serves to urge the wheel 42 into a so-called "closed" position in which at least one of its petals overlies the safety line retaining recess 60. A cover member 53 is provided on the head of the bolt 45 and serves to protect some of the operating parts of the device from ingress of dirt.

Figure 5:
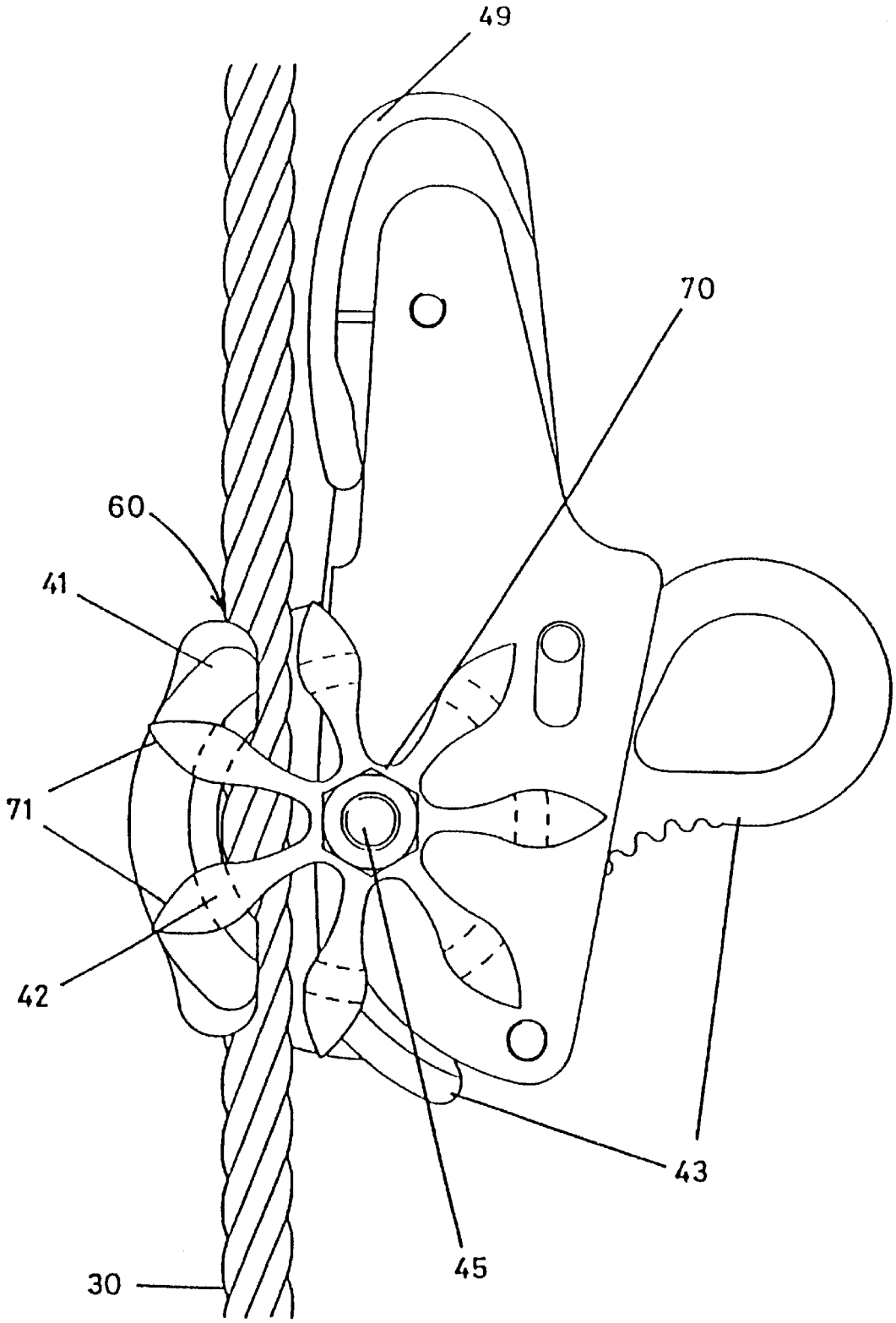
FIG. 5 shows a side view of the assembled device of FIG. 4.
Figure 6D:
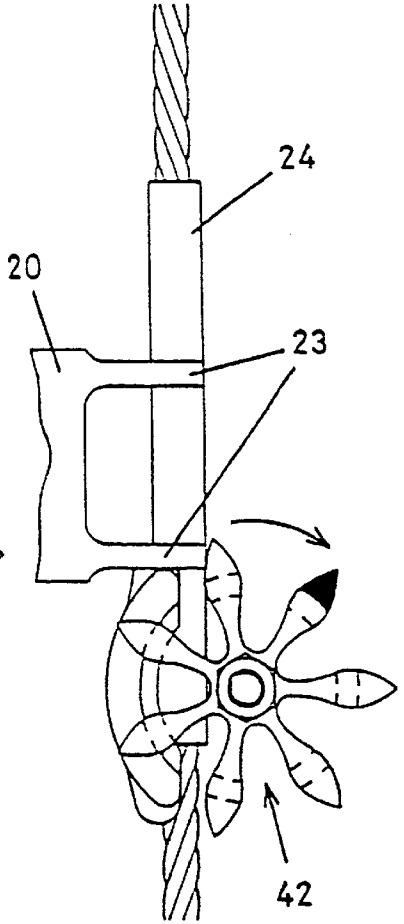
Figure 6C:
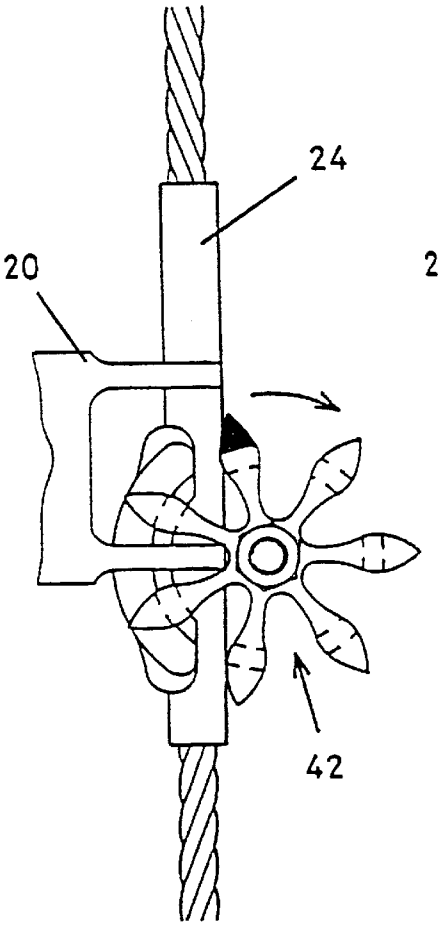
Figure 6B:
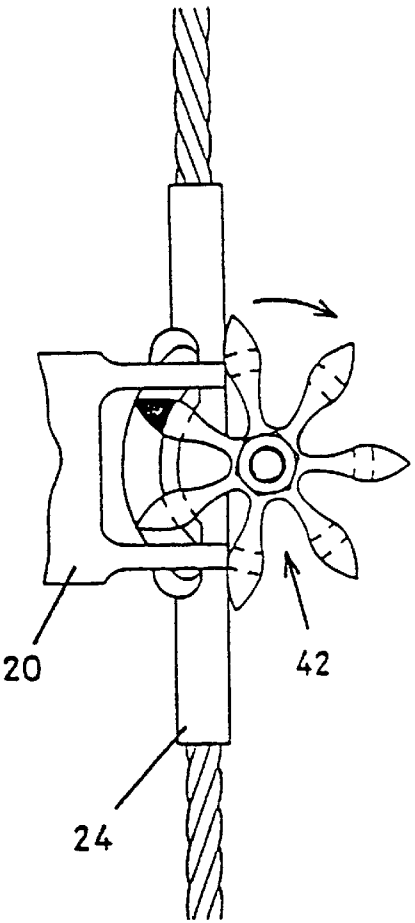
Figure 6A:
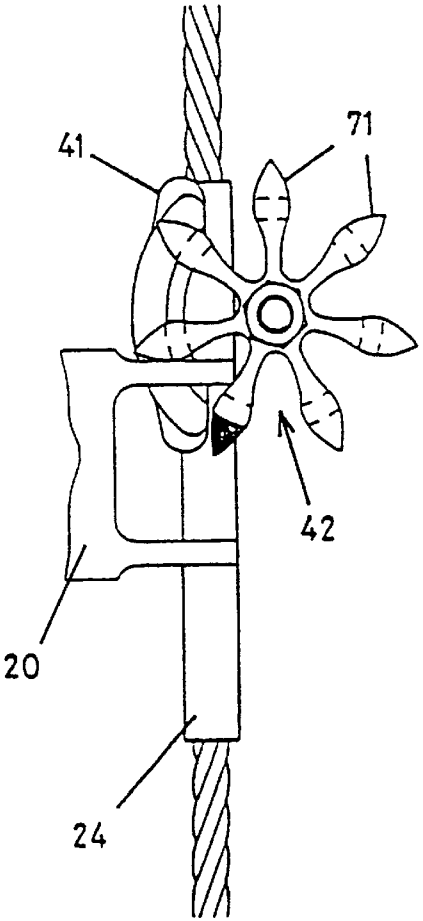

FIG. 5 shows a side view of the assembled invention with one of the side plates 48 omitted for clarity. In this view, the configuration of the wheel 42 can be clearly seen. It comprises a central hub 70 which receives the spindle or bolt 45 and a plurality of evenly-spaced radially-projecting petals 71. As shown, the disposition of the wheel 42 in relation to the body member 41 is such that the petals 71 execute a circular path which overlies the safety line retaining recess 60.

FIG. 5 also shows the cam member 43 in the raised position in which there is no engagement with the safety line 30. In normal use, under neutral loading, the cam member 43 is urged into the lock-on position by a combination of gravity acting on the cam center of gravity and tension in the tension spring 51. In this condition, the attachment device is firmly locked-on to the safety line 30 for all fall-arrest situations.

During normal climb or descent, the force on the connecting eye of the cam member 43 is due to the weight of the device. This force, and its direction (up, in the view depicted in FIG. 5) is sufficient to overcome the downward (opposing) force of the cam member 43 and thus moves the cam member anti-clockwise and releases the safety line lock-on. In such a position, normal climb or descent is possible without the cam member (43) locking on. In the event of a fall, the weight of the cam member 43 and the action of the tension spring 51 causes the device to lock on to the safety line.

In the installed condition, when the device is fully on the safety line, the safety line is totally retained by the concave safety line retaining recess 60 and the inside face of the wheel 42. Thus, there is no possibility of the device becoming inadvertently detached from the safety line.

FIG. 6 shows the various stages of passage of the invention past a typical safety line support bracket. The sequence of steps shown in the views (a) to (d) in fact illustrates a descent sequence, though it will be appreciated by persons skilled in the art that an ascent sequence could be described in analogous fashion.

FIG. 6(*a*) shows stage 1 in which, due to the handing of the system, the body member 41 runs down and partially entraps the guide tube 24 of a safety line support bracket 20. In this view, the body member 41 passes behind the curved bracket legs 23 and does not foul on them. These legs 23 maybe any shape in cross-section and not necessarily square as shown in the Figure. Wheel 42, which lies in a similar plane to the curved bracket legs 23, offers a gap between two adjacent petals 71. Should the situation arise where a gap is not in register with the bracket legs 23, contact between a petal tip and the legs 23 causes the wheel 42 to rotate slightly and thereby bring a gap into alignment with the leg.

In the presently-described sequence, since the motion of the invention is downwards, the bracket leg 23 abuts against the approaching petal and rotates it clockwise. In so doing, the invention moves to the position shown in FIG. 6(*b*). The condition represented by FIG. 6(*c*) is similar to that shown in FIG. 6(*a*) in that the device is shown traversing the second leg 23 of the safety line support bracket 20. Ultimately, the device passes beyond the bracket 20 as shown in FIG. 6(*d*).

Rotation of the wheel 42 during descent is caused by the weight of the device (and any attachment) being transmitted through contact with one or more bracket legs 23 in such a way that a turning force acts on the wheel 42.

During ascent, rotation is caused by the tension force in the user's lanyard attachment to the device. In this case, the applied force is transmitted through the axis of rotation of the wheel 42 and onto the contact point of a petal 71 with a bracket leg 23, thus causing a turning force on the wheel 42. The direction of this turning force is always correct for either descent or ascent (clockwise or anti-clockwise, respectively, as shown in FIG. 6).

The turning force on the wheel 42 is opposed by frictional forces occurring between the wheel 42 and the spindle or bolt 45 and also by frictional forces arising from relative movement between the wheel 42 and the body member 41. Such frictional forces may be reduced by the application of low friction coatings or other bearing technology.

In FIG. 7, view (a) shows an attachment device according to the invention in the closed and locked condition. In this condition, the central bolt 45 (which also serves as the spindle and retention means for the wheel 42) is locked into the body member 41 and may not be pulled away from it without first operating the lock release catch 44 by an intentional action. In the closed and locked condition, it is not possible for the device to be removed from or attached to a safety line system.

In the attached condition, i.e. in which a safety line 30 is accommodated in the safety line retaining recess 60, the device is always in a ready state to lock-on to the safety line in the event of a fall. The device may then be removed from the safety line system by depressing the release catch 44 against spring pressure and at the same time pulling the wheel in a direction away from the body member 41. Movement of the wheel is also effected against biasing spring pressure. This action creates an opening for withdrawal of the device from the safety line 30. The open condition is shown in FIG. 7(*b*).

When the external forces are removed, the internal springs 47*a* and 47*b* ensure that the wheel returns to its fully locked position and the release catch returns, together with the latching mechanism, to the fully latched condition.

FIG. 8 shows the internal workings of another, similar embodiment of release catch, in a direction along the axis of a safety line 30. In this Figure, cover member 53 has been omitted for clarity.

In view (a), corresponding to FIG. 7(*a*), the device is shown in the closed and locked condition. In this condition, the head 45*a* of the bolt 45 is captively held behind a shoulder 44*a* of the release catch 44. When the release catch 44 is depressed (i.e. moved in the direction of arrow C as depicted in view (a)), the head 45*a* of the bolt is freed from engagement with the shoulder 44*a*. However, by virtue of the return force of spring 47*a* which acts between the head 45*a* of the bolt 45 and an abutment surface provided on the body member 41, the bolt is prevented from movement towards the attachment/detachment position.

In order to achieve such movement, the combined wheel and bolt assembly 42, 45 must be grasped and pulled away from the body member 41 in the direction of arrow D, as shown in view (b). When the combined wheel and bolt assembly is released, the biasing pressure of spring 47*a* urges the assembly to return to the non-release position shown in FIG. 8(*a*). Additional return spring 47*b*, as best seen in view (a), urges the lock release catch 44 to its latching position.

Thus it can be seen that a device constructed in accordance with the invention provides a quick and simple method of attachment to and detachment from a safety line system.

FIG. 9 illustrates a few more ways in which the release mechanism of the invention may be implemented. In FIG. 9(*a*) a pull-release lever is shown. FIG. 9(*b*) shows a safety pin arrangement, whilst FIG. 9(*c*), which is a side view, shows a rotary release knob. Non-illustrated variants are also possible without departing from the scope of the invention.

FIG. 10 shows a variant of the invention incorporating a safety mechanism which minimises the risk of installing the device on a safety line in an inverted orientation.

In this Figure, views (a), (b), (d) and (e) are end views of a body member 41 and release catch 44 assembly looking in the direction of arrow A in FIG. 4. Views (c) and (f) are sectional views of the body member and release catch assembly taken on lines cc' and ff' of views (b) and (e), respectively.

In the safety mechanism of this embodiment, a detent member in the form of a ball 144 is accommodated in a channel 145 machined in the body member 41. Ball 144 is freely movable in the channel 145 and its rest position depends on the orientation of the fall arrest device. Release catch 44 is formed with a notch 245 in the side thereof adjacent channel 145. The position of notch 245 is arranged to coincide with that of channel 145 when the release catch is in its rest condition, i.e. the non-release condition. If the fall arrest device is oriented such that it might be installed on a safety line the wrong way round, ball 144 falls into notch 245 and prevents movement of the release catch in the release direction. This condition is shown in views (b) and (c).

By inverting the fall arrest device, ball 144 is caused to move to the other end of channel 145 under the influence of gravity, as shown in view (d). Release catch 44 is no longer fouled by the ball and may be moved in the release direction against the biasing force of springs 47*b*, as shown in-views (e) and (f).

Although this embodiment has been described in relation to Figures which show a channel and a notch on only one side of the body member 41 and release catch 44, respectively, it will be understood by persons skilled in the art that these components can be manufactured with mirror-image formations on their other sides. This minimises the number of components which have to be manufactured and kept in stock. Depending on which side the ball 144 is located, the device is able to be configured for either "left-handed" or "right-handed" operation.

FIG. 11 shows an alternative safety mechanism which works on similar principles to the safety mechanism described in relation to FIG. 10 above.

In FIG. 11, views (a), and (b) are part-sectional views of a cover 53 and release catch 44 assembly looking in the direction of arrow B in FIG. 4. View (c) is an end view of the cover 53 taken on lines cc' of view (b).

In this arrangement, a detent member in the form of a pin 244 is housed in a channel 246 formed in release catch 44. Pin 244 is freely movable in the channel 246, its rest position depending on the orientation of the fall arrest device. Cover member 53 is formed with a cut-out 153 in one of its internal webs 253. The position of cut-out 153 is arranged to coincide with that of channel 246 when the release catch is in its rest condition, i.e. the non-release condition.

If the fall arrest device is oriented such that it might be installed on a safety line the wrong way round, pin 244 falls into cut-out 153 and prevents movement of the release catch in the release direction. This condition is shown in view (a).

By inverting the fall arrest device to the orientation shown in view (b), pin 244 is caused to travel to the other end of channel 246 under the influence of gravity. At this point, the pin 244 is prevented from further movement which would cause it to foul motion of the release catch 44 in the release direction by continuous web 254. This web has no cut-out portion and provides a smooth surface along which the lowermost end of pin 244 can slide in response to motion of release catch 44. Web 253 having cut-out portion 153 and continuous web 254 are best seen in FIG. 11(*c*).

FIGS. 12, 13, 14 and 15 show a number of design modifications which may be adopted. In FIG. 12, a body member 41 is shown in which a groove 41*a* is provided for cooperation with a projection 71*a* formed on each of the petals 71 of the wheel 42 (only one petal shown). In FIG. 13, neither the body member 41 nor the wheel 42 is formed with any projections and/or grooves. FIG. 14 shows a particular form of slipper which comprises a roller 80 adapted to assist in normal passage of the device along the safety line by engagement therewith in advance of (or behind) the device. FIG. 15 depicts another modification in which the safety line retaining recess 60 is equipped with a roller 61 to ease passage of the device along the safety line in normal use. The roller 61 is positioned in such a way that it cannot interfere with the lock-on capability of the device in the event of a fall.

What is claimed is:

1. A vertical fall arrest device adapted for attachment to and detachment from an elongate safety line, said device comprising:

a body member;

a rotary member having at least one recess formed in its periphery;

safety line retaining means extending between the body member and the rotary member and being adapted to retain a safety line in a space defined between the body member and the rotary member;

locking means for locking the device to said elongate safety line in a fall arrest situation;

biasing means to urge said locking means into locking engagement with a safety line accommodated in the safety line retaining means in response to a sudden change in load experienced by the device; and means for attaching a personnel safety cable to the device;

wherein said rotary member, said body member and said retaining means are arranged in a working disposition in which the rotary member is rotatably mounted in relation to the retaining means and the body member and wherein the or each recess is adapted to traverse support means used to support an elongate safety line without the need for user manipulation by rotation of the rotary member relative to the retaining means and the body member such that elements of said support means are successively received, guided and passed by a recess automatically;

characterized in that said vertical fall arrest device further comprises a manually-operable opening mechanism means for releasing at least one of the rotary member, the body member and the retaining means from its working disposition in relation to the others of such parts so that said at least one of said rotary member, body member and retaining means can be moved relative to the others of such parts, means for limiting the movement of the at least one of said rotary member, body member and retaining means from its working disposition to a predetermined limited amount just sufficient to enable a safety line to be introduced into or removed from said space but will not allow said at least one of said rotary member, body member and retaining means to be detached from the device, thereby enabling the device to be attached to or detached from the safety line.

2. A vertical fall arrest device as claimed in claim 1 further comprising releasable means for maintaining the rotary member, the body member and the retaining means in a closed condition in which introduction or removal of a safety line is prevented.

3. A vertical fall arrest device as claimed in claim 2 wherein the releasable means includes positive locking means.

4. A vertical fall arrest device as claimed in claim 3 wherein the positive locking means comprises a latching mechanism biased to its non-release position.

5. A vertical fall arrest device as claimed in claim 4 wherein a release means for the latching mechanism incorporates a safety mechanism which alerts a user to the fact that the vertical fall arrest device is being attached in the wrong orientation.

6. A vertical fall arrest device as claimed in claim 5 wherein the safety mechanism comprises a detent member which is freely-movable under the influence of gravity between an engaged position in which it fouls the release means and jams it against actuation, and a free position which frees the release means and renders it operable, depending on the orientation of the device.

7. A vertical fall arrest device as claimed in claim 6 wherein the detent member is a ball or pin accommodated in a channel in the body member or a cover member associated therewith.

8. A vertical fall arrest device as claimed in claim 6 wherein the detent member is a ball or pin accommodated in a channel in the release means.

9. A vertical fall arrest device as claimed in claim 2 wherein the rotary member is urged by biasing means into the closed position.

10. A vertical fall arrest device as claimed in claim 2 wherein a central spindle upon which the rotary member is rotatably mounted is releasably locked into the body member by positive locking means.

11. A vertical fall arrest device as claimed in claim 1 wherein the rotary member is provided with a groove on the surface thereof facing the body of the device for cooperation with a raised projection formed on the body and/or the retaining means.

12. A vertical fall arrest device as claimed in claim 1 wherein the rotary member is a wheel having a plurality of petals projecting radially from a hub of the wheel, said petals defining between adjacent pairs thereof recesses for traversing safety line support means.

13. A vertical fall arrest device as claimed in claim 1 further comprising at least one slipper element for maintaining the desired orientation of the device with respect to a safety line during climb or descent.

14. A vertical fall arrest device as claimed in claim 13 wherein the slipper element comprises a roller or rollers.

* * * * *

UNITED STATES PATENT AND TRADEMARK OFFICE

CERTIFICATE OF CORRECTION

PATENT NO. : 6,263,999 B1
DATED : July 24, 2001
INVENTOR(S) : G.F. Atkinson et al.

It is certified that error appears in the above-identified patent and that said Letters Patent is hereby corrected as shown below:

Title page,
Please change "PCT No.: PCT/GB97/00734" to read:
-- PCT No.: PCT/GB95/00734 --.

Signed and Sealed this

Twenty-sixth Day of March, 2002

*Attest:*

*Attesting Officer*

JAMES E. ROGAN
*Director of the United States Patent and Trademark Office*